United States Patent [19]

Gordon

[11] Patent Number: 5,067,605

[45] Date of Patent: Nov. 26, 1991

[54] SINGLE PAPER DISPENSER

[75] Inventor: Roger G. Gordon, Richmond, Calif.

[73] Assignee: Unirac Corp., Richmond, Calif.

[21] Appl. No.: 559,529

[22] Filed: Jul. 19, 1990

Related U.S. Application Data

[63] Continuation of Ser. No. 327,367, Mar. 22, 1989, abandoned, which is a continuation of Ser. No. 185,254, Apr. 19, 1988, abandoned, which is a continuation of Ser. No. 877,917, Jun. 24, 1986, abandoned, which is a continuation-in-part of Ser. No. 789,343, Oct. 16, 1985, Pat. No. 4,667,803, which is a continuation of Ser. No. 598,646, Apr. 10, 1984, abandoned.

[51] Int. Cl.[5] ..... G07F 11/40

[52] U.S. Cl. ..... 194/248; 221/227; 221/231; 221/241

[58] Field of Search ..... 221/155, 195, 227, 230, 221/231, 232, 240, 241, 266, 254, 277, 245; 194/233, 248

[56] References Cited

U.S. PATENT DOCUMENTS

| | | | |
|---|---|---|---|
| 927,055 | 7/1909 | Kraemer et al. | 221/245 X |
| 1,263,033 | 4/1918 | Campbell | 221/240 X |
| 1,621,960 | 3/1927 | Stewart et al. . | |
| 2,396,411 | 3/1946 | Cameron | 221/231 X |
| 2,926,814 | 3/1960 | Utiger | 221/231 X |
| 3,062,407 | 11/1962 | Cordis | 221/230 X |
| 3,168,212 | 2/1965 | Edwards | 221/231 X |
| 3,263,859 | 8/1966 | Searle | 221/227 |
| 3,957,175 | 5/1976 | Gordon | 221/215 |
| 4,063,629 | 12/1977 | Gordon | 194/1 K |
| 4,085,864 | 4/1978 | Gordon | 221/155 |

*Primary Examiner*—F. J. Bartuska

*Attorney, Agent, or Firm*—Townsend and Townsend

[57] ABSTRACT

The present invention provides a single paper dispenser. An enclosure has a transverse aperture at one end and a discontinuous transverse member near the aperture. A horizontal stack of papers is located within the enclosure and a mechanism is provided to bias the papers against the transverse member. A cam system is located within the enclosure and rotates about an axis parallel to the transverse aperture. Tongues on the cams move upwardly through the discontinuities in the transverse member and then forwardly as the cam system is rotated. While the cam system is rotated, the mechanism for biasing the papers against the transverse member is disabled. The forwardmost paper is dispensed by rotating the cam system while the remainder of the stack is immobilized to separate it from the remainder of the stack and drop it to the transverse aperture.

16 Claims, 8 Drawing Sheets

SINGLE PAPER DISPENSER

This application is a continuation of Ser. No. 07/327,367, filed Mar. 22, 1989, now abandoned, which is a continuation of Ser. No. 07/185,254, filed Apr. 19, 1988, now abandoned, which is a continuation of Ser. No. 06/877,917, filed Jun. 24, 1986, now abandoned, which is a continuation-in-part of Ser. No. 06/789,343, filed Oct. 16, 1985, now U.S. Pat. No. 4,667,803, which is a continuation of Ser. No. 06/598,646, filed Apr. 10, 1984, now abandoned.

This application is a continuation-in-part of my copending application of the same title, Ser. No. 789,343, filed Oct. 16, 1985; which is in turn a continuation of my application, Ser. No. 598,646, filed Apr. 10, 1984, now abandoned.

BACKGROUND OF THE INVENTION

The present invention relates to a dispenser of single papers, and in particular to a coin-operated paper dispenser in which the papers are individually dispensed upon insertion of the proper coinage.

The typical street corner paper rack has a metal box which holds a vertical stack of papers, and a front vertical or near-vertical door which can be opened when the proper coinage is inserted. Once the front door is open, the user has access to the entire stack of papers, but it is presumed that the user has use for only one paper and will leave the rest for the next customer. Unfortunately, this system is defenseless against the unscrupulous user who might insert the necessary coinage to obtain a single paper, but remove the entire stack and sell the papers on his own at considerable profit. Also, where patronage is heavy, the temptation to leave the door open for the next purchaser is at times overwhelming.

The desirability of a dispenser which would issue only one paper at a time when the appropriate coinage is inserted is manifest. However, the design of such a single paper dispenser which will withstand abuse and resist tampering in a street corner environment, and adapt to the varying thicknesses of different papers, has proved to be difficult. Attempts at designing such dispensers are illustrated in U.S. Pat. Nos. 1,263,033; 1,621,960; 2,396,411; 2,926,814; 3,263,859; 3,957,175; and 4,085,864, but these dispensers are not used extensively. At present, the conventional fully openable rack is used almost exclusively despite its deficiencies because single dispenser designs have proved to be unequal to the task.

U.S. Pat. No. 2,396,411 to Cameron discloses a paper vending machine in which a stack of papers supported at the back by a movable plate slides down an inclined ramp against a stop. Cams are provided for lifting the forwardmost paper over the stop to dispense one paper at a time. It would appear that the Cameron device would not operate efficiently because the stack of papers is forced against the stop at all times, jamming the device when there is an attempt made to dispense the forwardmost one of them.

SUMMARY OF THE INVENTION

The present invention provides a single paper dispenser. An enclosure has a transverse aperture at one end and a discontinuous transverse member near the aperture. A horizontal stack of papers is located within the enclosure and a mechanism is provided to bias the papers against the transverse member. A cam system is located within the enclosure and rotates about an axis parallel to the transverse aperture. Tongues on the cams move upwardly through the discontinuities in the transverse member and then forwardly as the cam system is rotated. While the cam system is rotated, the mechanism for biasing the papers against the transverse member is disabled. The forwardmost paper is dispensed by rotating the cam system while the remainder of the stack is immobilized to separate it from the remainder of the stack and drop it to the transverse aperture.

It is preferred that the horizontal stack of papers be located on a belt which is biased toward the apertured end of the enclosure. A brake is provided for preventing movement of the belt, and the cam system includes certain cams which operate the brake to immobilize the belt as the paper is being dispensed. A ratchet and pawl system and coin mechanism control the operation of the device so that the device cannot be manipulated to dispense multiple papers without the insertion of new coinage.

While the term "papers" is used herein, and the design is primarily for conventional daily or weekly newspapers, it is to be understood that the term "papers" is used in a generic sense to include flyers, information publications and other types of printed matter which might be dispensed in the fashion indicated.

The present invention provides a reliable and useful mechanism for dispensing single papers, and represents a feasible alternative to the open face racks now in common use. Prior suggested designs for such a rack have not operated in a sufficiently reliable and trouble-free fashion so as to provide such a practical alternative. Such prior designs are typified by the Cameron patent which does not properly control the position of the remainder of the stack while one paper is being dispensed and appears subject to jamming and other types of malfunction.

The novel features which are characteristic of the invention, as to organization and method of operation, together with further objects and advantages thereof will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DESCRIPTION OF THE PREFERRED EMBODIMENT

Figure 1:
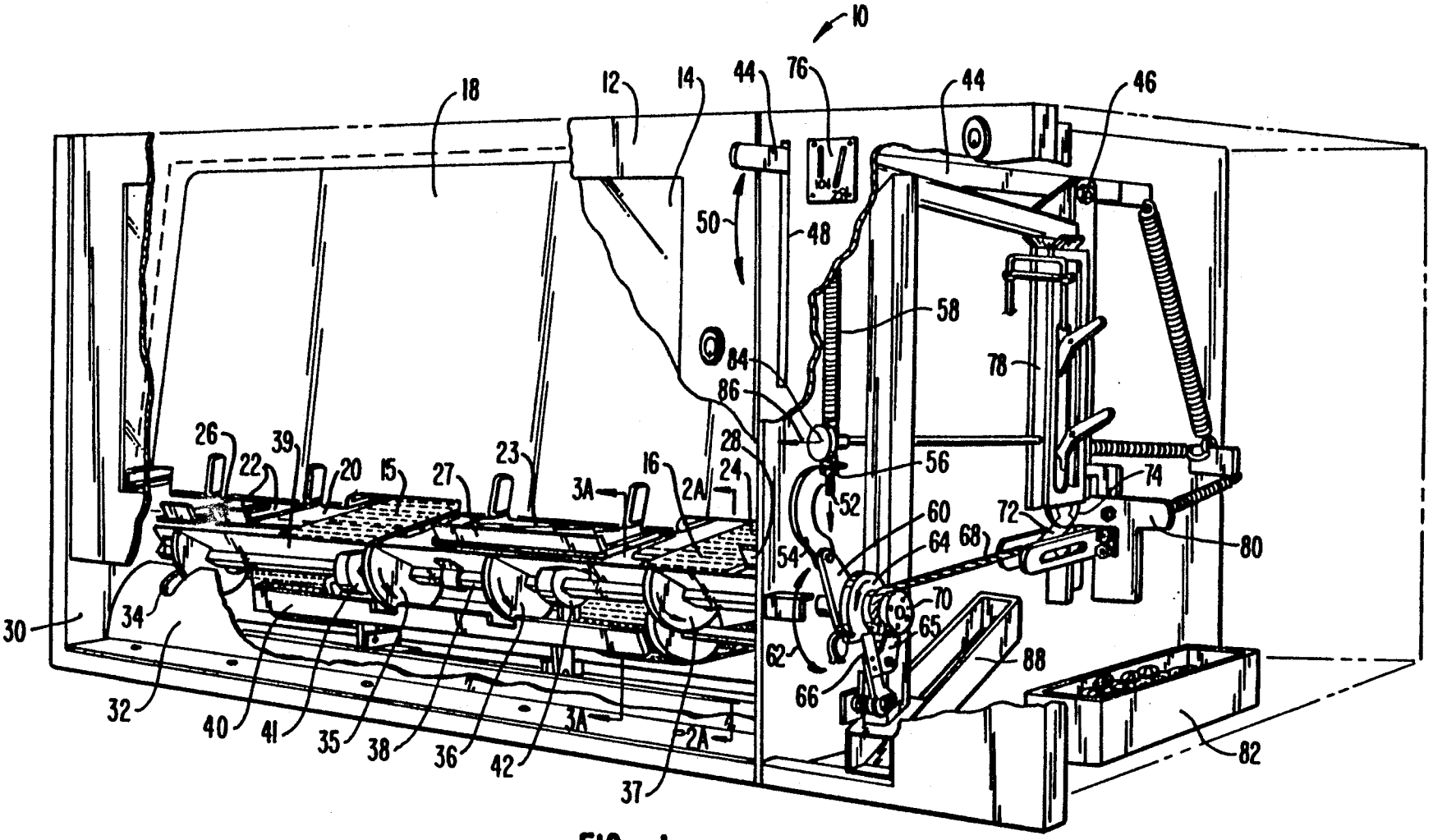
FIG. 1 is a perspective view of the preferred embodiment of the present invention.

The preferred embodiment 10 of the present invention is illustrated generally by way of reference to FIG. 1. Enclosure 10 is shown in its empty or unloaded configuration, and when loaded a horizontal stack of papers is contained within the enclosure with their folded edge resting on belts 15, 16 and the back of the stack resting on backplate 18. Backplate 18 is fixed to and extends upwardly from belts 15, 16 so that the belts and the backplate move as a unit. A transverse plate 20 is located near the front of enclosure 12, and contains a plurality of adjustable plates 22-24. Plates 22-24 each have an upwardly disposed lip 26-28 against which the stack of papers is pressed by the combined action of belts 15, 16 and backplate 18.

The forward end of enclosure 12 has an open transverse slot 30. A curved guide plate 32 provides a path to slot 30. A plurality of dispenser cam elements 34-37 and antitheft plate 39 are located on a cam shaft 38. A movable brake shoe 40 is disposed near the forward ends of belts 15, 16, and cam shaft 38 has a pair of brake cam elements 41, 42, as well as dispenser cam elements 34-37. When cam shaft 38 is rotated, dispenser cam elements 34-37 will separate the forwardmost paper and drop it in slot 30 while brake cam elements 41, 42 press brake shoe 40 against belts 15, 16 to immobilize the remainder of the stack, as will be described in more detail hereinafter.

A handle 44 is pivotable about shaft 46, and extends through a slot 48 so that it can be operated by a user, as illustrated by arrow 50. A support shaft 52 extends downwardly from handle 44 through an aperture in linkage 54. A stop nut 56 limits upward travel of support shaft 52, but the support shaft is not otherwise connected to linkage 54. A spring 58 circumscribes support shaft 52 and engages the upper portion of linkage 54 so that downward movement of handle 44 exerts a force on linkage 54 limited by the compression of spring 58.

A crank 60 is connected to linkage 54, and fixed to cam shaft 38 so that downward movement of handle 44 causes rotation of cam shaft 38, as illustrated by arrow 62. A ratchet 64 on cam shaft 38 and a pawl 65 prevent reverse rotation of cam shaft 38 until handle 44 has reached the full extent of its downward travel. Pawl release 66 allows the mechanism to return to its initial configuration at the end of a cycle.

A cable 68 is wrapped around a pulley 70 fixed to cam shaft 38. Rotation of cam shaft 38 causes a coin bar (not visible) with a coin wedge 72 to be drawn forwardly. As will be illustrated in more detail hereinafter, if the proper coinage such as quarter 74 has been inserted through slots 76 into coin holder 78, the coin bar will be released from stop 80, allowing cam 38 to rotate and dispensing cam elements 34-37 to dispense the forwardmost paper. In such event, the coinage will drop into a coin box 82. A coin return button 84 is provided which can be pulled as illustrated by arrow 86 to drop the coin into return chute 88.

Figure 2A:
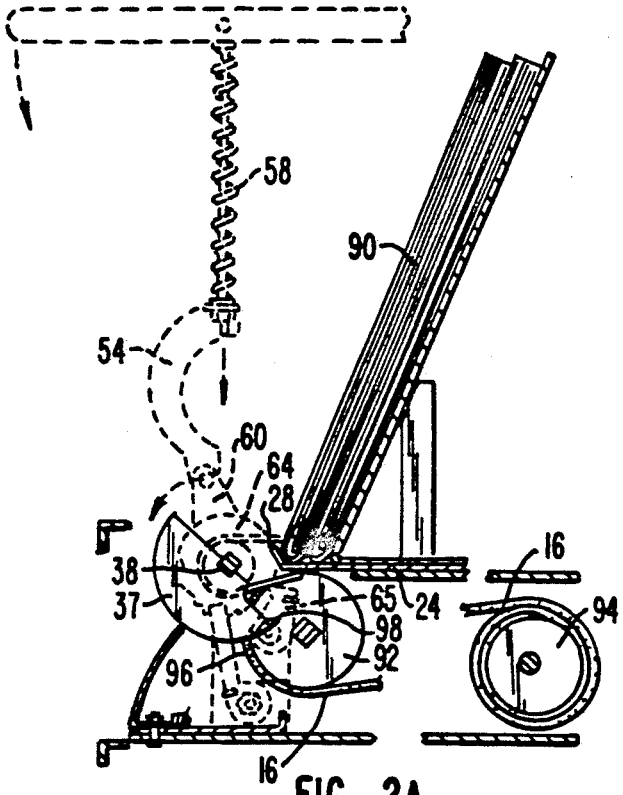
FIG. 2A is a fragmentary sectional view taken along lines 2A—2A of FIG. 1 with the pawl and ratchet mechanism shown in phantom.

The operation of the device in dispensing a paper is illustrated in more detail by way of reference to FIGS. 2A-D and 3A-D in combination. In FIG. 2A, cam shaft 38 is depicted prior to rotation thereof. The forwardmost paper 90 has a lower edge resting against lip 28 of adjustable member 24. Belt 16 wraps around a forward idler pulley 92, and extends to and wraps around a spring loaded pulley 94 which provides a constant tension on the belt. Cam element 37 has a tongue portion 96 with a pointed tip 98 poised below the lower edge of forwardmost paper 90. Handle 44, spring 58, linkage 54 and crank 60 are in position to rotate cam shaft 38 as illustrated by the arrow. Pawl 65 is pressed against ratchet 64 by spring 100.

Figure 3A:
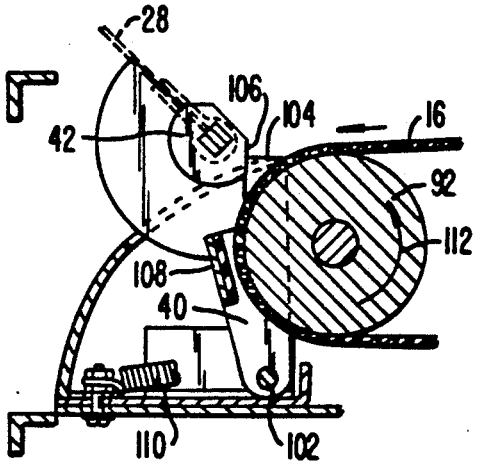
FIG. 3A is a fragmentary sectional view taken along lines 3A—3A of FIG. 1, and FIGS. 3B–D are a sequence of views starting with FIG. 3A representing the operation of the device and corresponding to FIGS. 2A–D respectively.
Figure 2B:
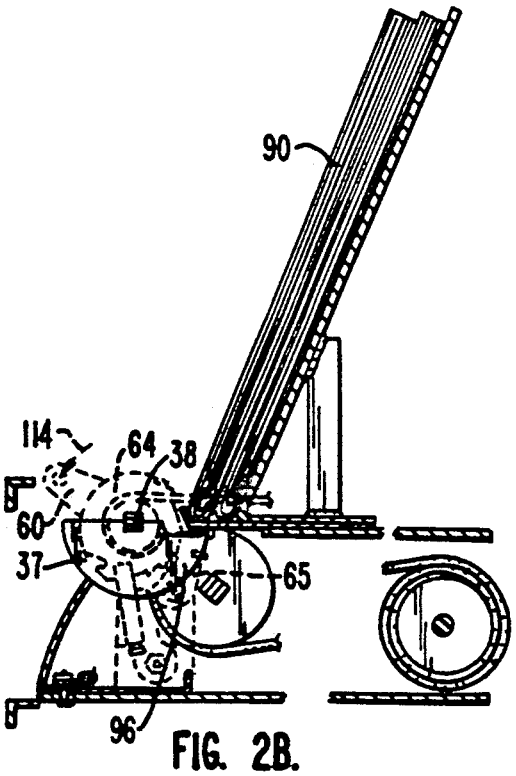
FIGS. 2B–D represent a sequence of views starting with FIG. 2A illustrating the operation of the preferred embodiment.

As illustrated in FIG. 3A, brake shoe 40 is pivotable about shaft 102, and has vertical extension 104 in contact with brake cam element 42. In the rest position, extension 104 engages a flat 106 on brake cam 42, allowing the brake pad 108 on brake shoe 40 to be drawn away from belt 16 by spring 110. In this configuration, belt 16 is free to move around idler pulley 42 as illustrated by arrow 112. Antitheft plate 39 prevents the unscrupulous user from merely reaching in and taking a paper.

Figure 3B:
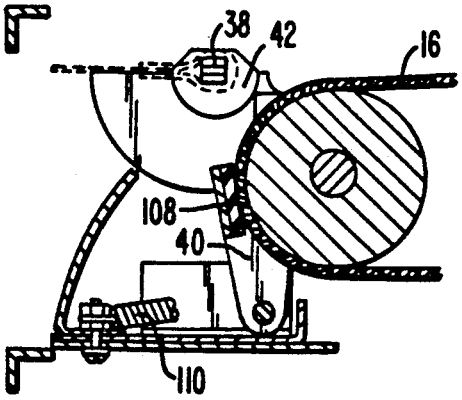

When handle 44 is depressed, crank 60 will rotate cam shaft 38, as illustrated by arrow 114 in FIG. 3B. The teeth on ratchet 64 are directed in a counterclockwise fashion, allowing the cam shaft to rotate clockwise with pawl 65 sliding over the teeth. The tongue portion 96 of dispensing cam element 37 will engage the lower folded edge of forwardmost paper 90.

As illustrated in FIG. 3B, the initial rotation of cam shaft 38 will cause brake cam 42 to pivot brake shoe 40 so that brake pad 108 is pressed against belt 16, preventing belt 16 (and belt 15) from moving. Dispensing cam 37 is initially positioned a sufficient distance from the lower edge of forwardmost paper 90 (see FIG. 2A) so that the dispensing cam does not engage the paper until brake pad 108 is pressed against belt 16 so that the dispensing of the forwardmost paper does not begin until the belts are immobilized.

Figure 2C:
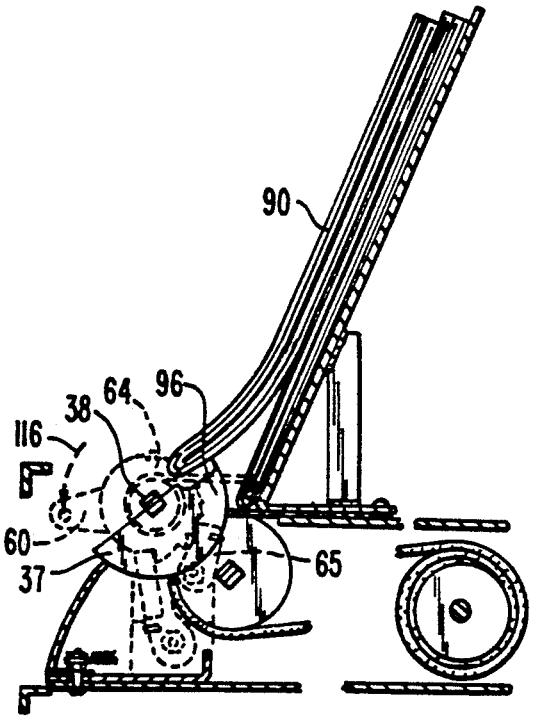
Figure 3C:
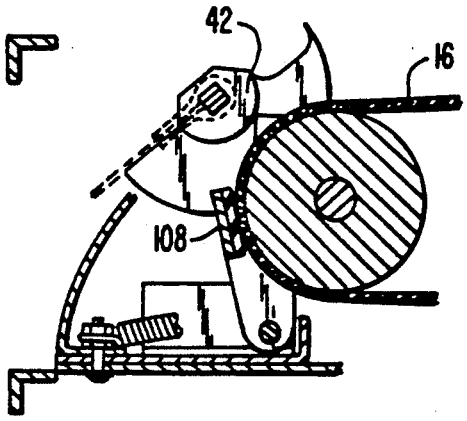

The initial dispensing of forwardmost paper 90 is illustrated by reference to FIGS. 2C and 3C in combination. The tongue 96 of dispensing cam 37 lifts the lower edge of forwardmost paper 90, and separates the forward edge from the stack. As crank 60 is rotated as illustrated by arrow 116, cam shaft 38 continues to rotate, with pawl 65 sliding along the surface of ratchet 64. The teeth on the surface of the ratchet engage pawl 65 to prevent cam shaft 38 from being rotated in the reverse direction, which would allow the user to manipulate the device to dispense more than one paper. Brake pad 108 remains pressed against belt 16 by brake cam 42 to immobilize the belt and keep the remainder of the paper stack in position.

Figure 2D:
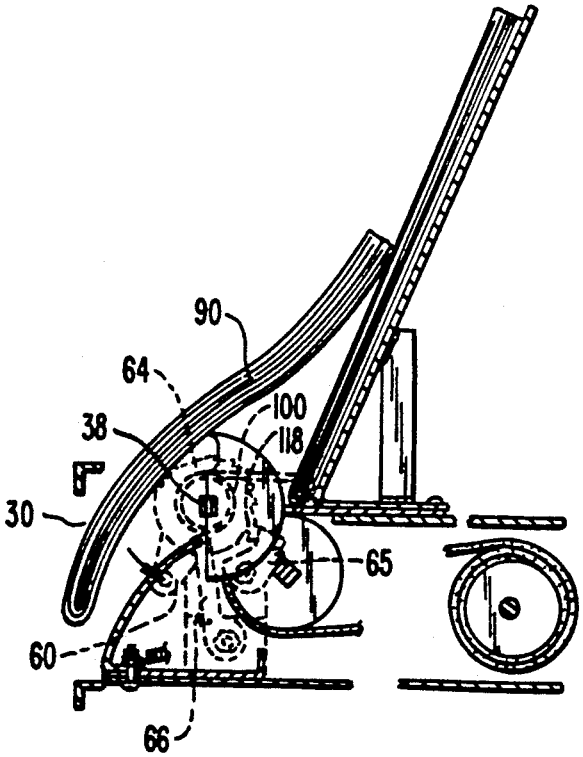
Figure 3D:
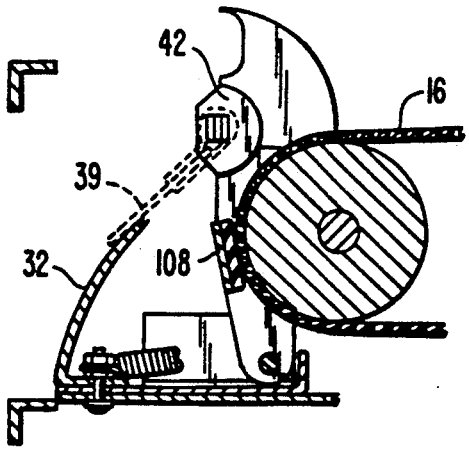

As cam shaft 38 is rotated further by crank 60, as illustrated in FIG. 2D, forwardmost paper 90 is lifted over the retaining lip and cam mechanism so that it will fall into transverse slot 30, dispensing the single paper in the appropriate fashion. Ratchet 64 contains a single large tooth 118 which forces pawl 65 out further than the others, causing projection 120 to engage cam release 66 so that the pawl will be held away from the ratchet until the ratchet returns to its initial rest position. Pawl 65 is only released after cam shaft 38 has been rotated sufficiently to insure that the coinage has dropped into the coinage box (see FIG. 1). As cam shaft 38 completes its rotation, brake cam element 42 maintains brake pad 108 in contact with belt 16 so that the belt is immobilized through the entire dispensing operation. Antitheft plate 39 contacts deflection plate 32 to provide a continuous path for the dispensed paper.

Figure 4:
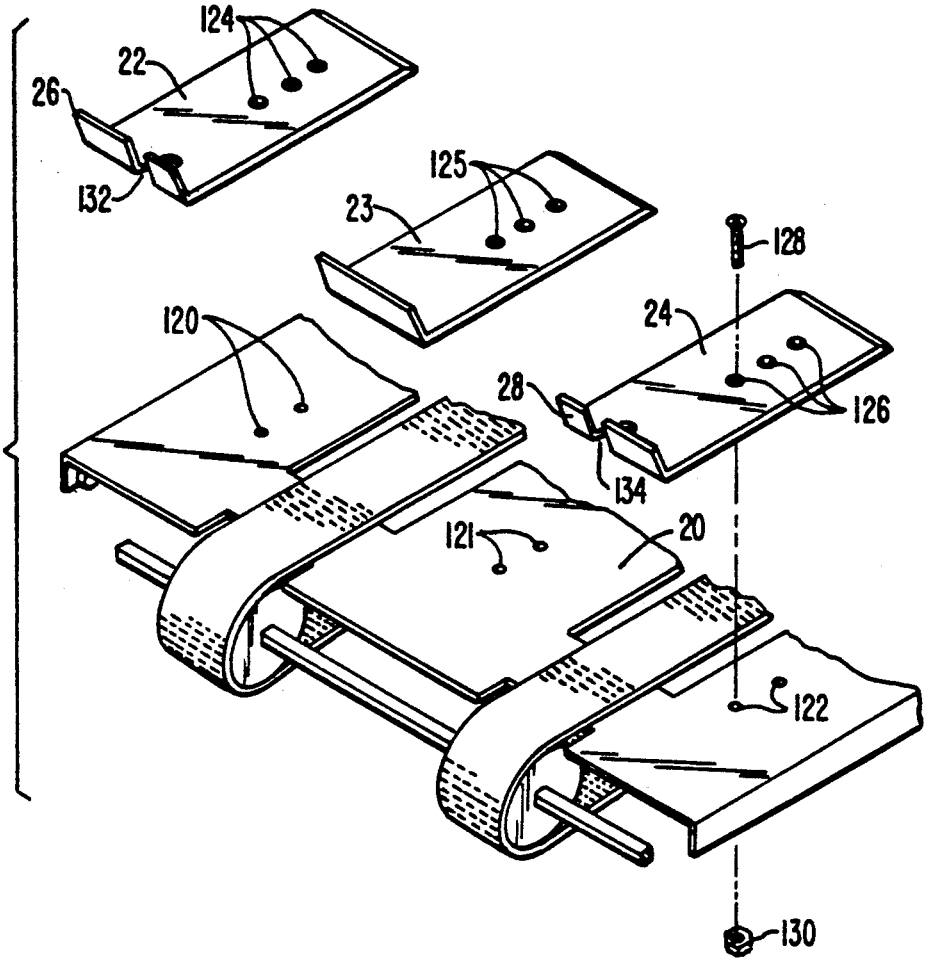
FIG. 4 is an exploded fragmentary view of the transverse retention system of the preferred embodiment.

As illustrated in FIG. 4, transverse plate 20 has sets of apertures 120–122. Adjustable plates 22–24 contain countersunk sets of apertures 124–126. The position of plates 22–24 can thus be adjusted in a linear fashion relative to transverse plate 20. As illustrated in FIG. 4, a screw 128 is inserted through one of the apertures 126 in plate 24 and one of the apertures 122 in transverse plate 20, and secured in position with nut 130, to provide the appropriate adjustment, and plates 122, 123 are similarly adjustable.

Figure 5:
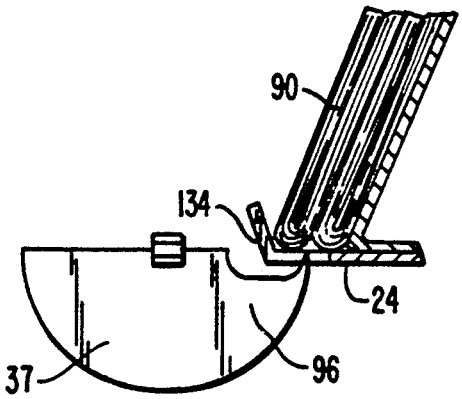
FIGS. 5 and 6 are fragmentary sectional views illustrating the adjustment of the transverse retention member of the preferred embodiment.
Figure 6:
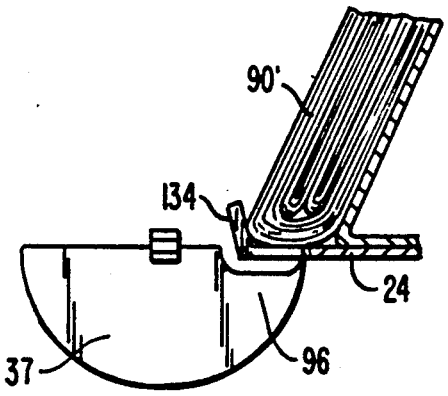

FIG. 5 illustrates the adjustment of the plate such as plate 24 to accommodate an average size paper 90. Forward adjustment of plate 24, as illustrated in FIG. 6, allows thicker papers such as 90′ to be dispensed. Accordingly, plates 22–24 can easily be adjusted fore and aft to accommodate relatively small papers such as a small local weekly to large papers such as major city Sunday editions.

Referring back to FIG. 4, plate 22 has a slot 132 in its forward edge, including lip 26. A similar slot 134 is provided in plate 24, including its forward lip 28. As illustrated in FIGS. 5 and 6, the tongue portion 96 of dispensing cam 37 projects through slot 134 in plate 24. Similarly, the tongue portion of dispensing cam 34 (see FIG. 1) projects through slot 132. Dispensing cams 35 and 36 pass through the gaps between plates 22, 23, and 24. Accordingly, the transverse stop for the papers is discontinuous to allow the dispensing cams to move through the stop and engage the forwardmost paper.

Figure 7:
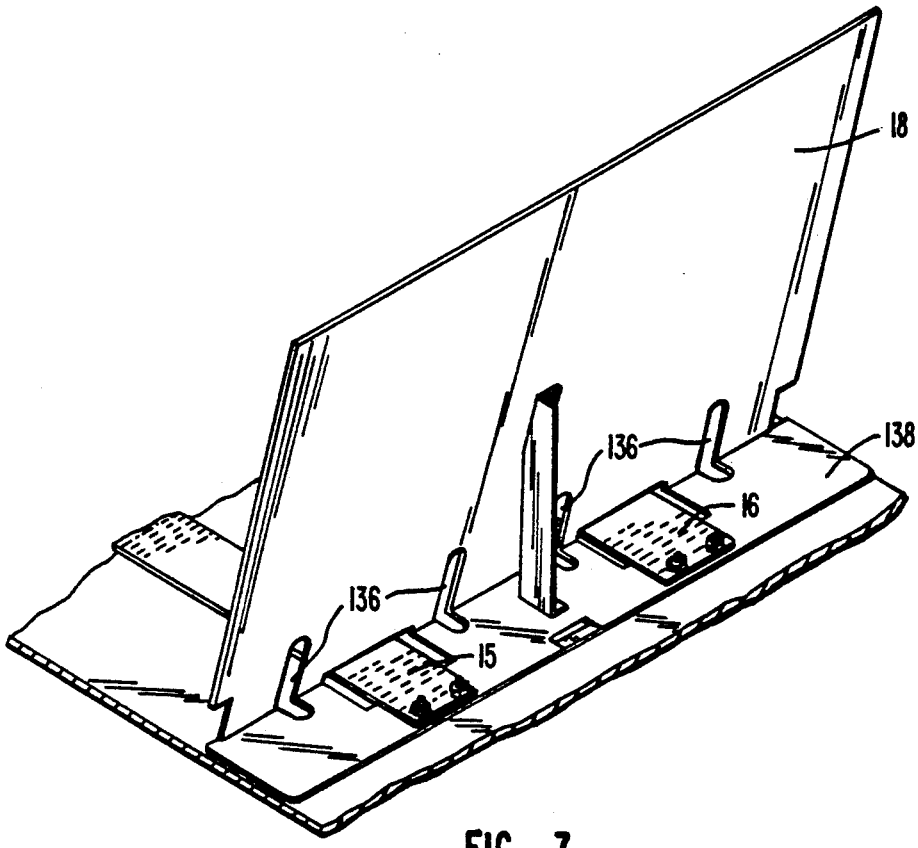
FIG. 7 is a fragmentary rear sectional view of the backplate of the preferred embodiment.

As illustrated in FIG. 7, backplate 18 has a set of four slots 136, again to accommodate the dispensing cams, and to allow even the last paper on the stack to be dispensed. Backplate 18 has a lower flange 138 to which belts 15, 16 are secured. The papers are fully supported by belts 15, 16 and backplate 18, allowing them to move freely except when the brake is engaged, at which point the stack of papers is immobilized.

Figure 8A:
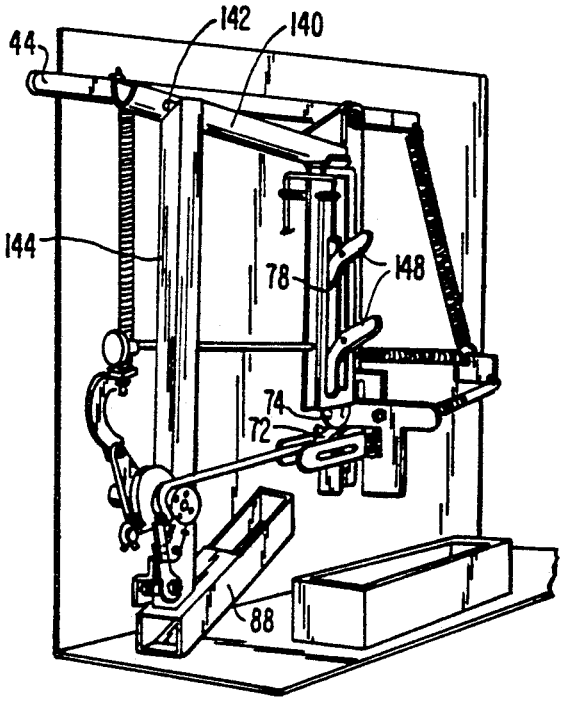
FIGS. 8A-D are a sequence of fragmentary perspective views illustrating the operation of the handle and coin mechanism of the preferred embodiment and correspond to FIGS. 2A-D and 3A-D.
Figure 9A:
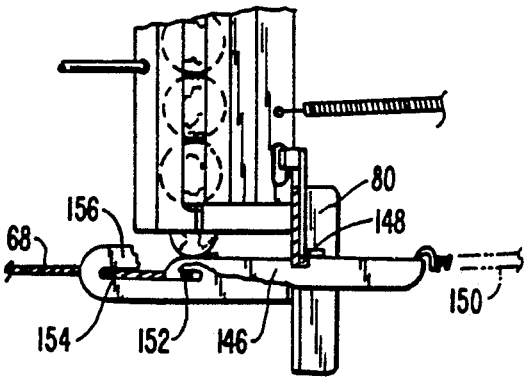
FIG. 9A-D are a sequence of fragmentary sectional views illustrating the operation of the coin holder of the preferred embodiment and correspond to FIGS. 2A-D, 3A-D and 8A-D respectively.

FIG. 8A illustrates the coin mechanism with a quarter 74 inserted. A chute 140 runs from the coin slot 76 (see FIG. 1) to coin holder 78. A slot 142 is provided on the side of chute 140, and sized so that improper coinage such as pennies fall through the slot, down shaft 144 and out coin return chute 88. Proper coinage traverses chute 140, and drops down through coin holder 78 to rest on the ramp 72 of coin bar 146, as illustrated in FIG. 9A. Dogs 148 are provided in coin holder 78 to hold quarter 74 down, dogs 148 being located so as to hold the proper coinage down while allowing improper coinage to rise freely.

FIGS. 8A and 9A illustrate the coin mechanism with the proper coinage inserted, but before handle 44 has been operated to dispense a paper. In this position, a slot 148 is engaged with stop 80. The forward portion of coin bar 146 has a pin 152 which slides in a slot 154 in a holding member 156. The aft end of coin bar 146 is biased upwardly by spring 150. In the absence of proper coinage, manipulation of handle 44 will draw cable 68 forwardly, cable 68 being attached to coin bar 146. However, the movement of coin bar 146 is restricted because the back of slot 148 will engage stop 80, preventing the device from being operated.

Figure 8B:
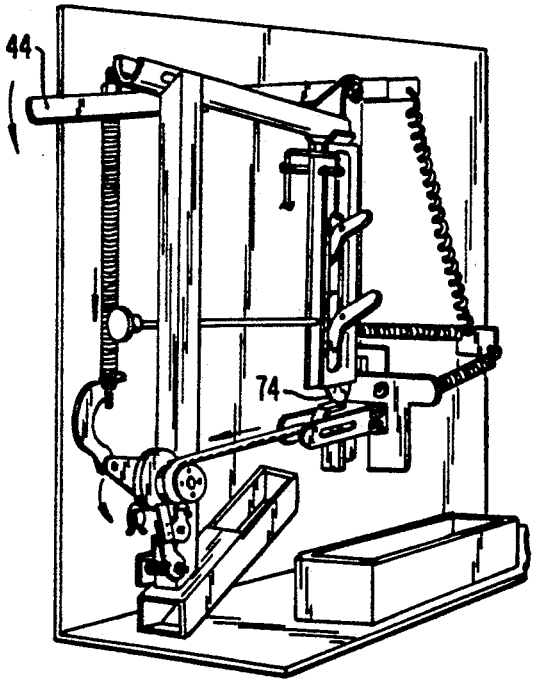
Figure 9B:
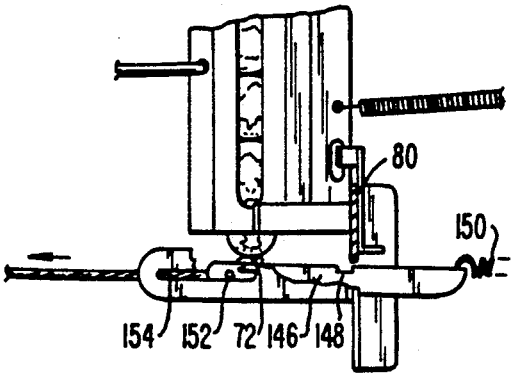

As illustrated in FIGS. 8B and 9B, with the insertion of proper coinage, such as quarter 74, downward movement of handle 44 draws cable 68 forwardly. Ramp 72 on coin bar 146 causes the coin bar to rotate downwardly about pin 152 in slot 154. Such downward movement is accommodated by spring 150, allowing slot 148 in coin bar 146 to pass beneath stop 80.

Figure 8C:
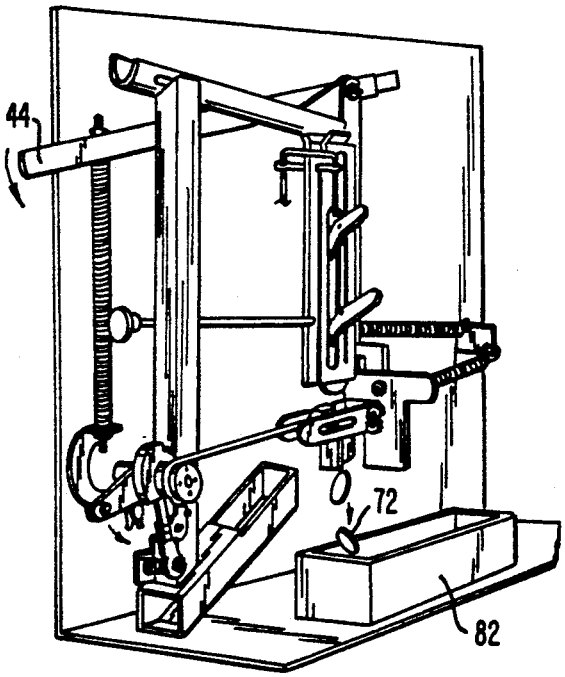
Figure 9C:
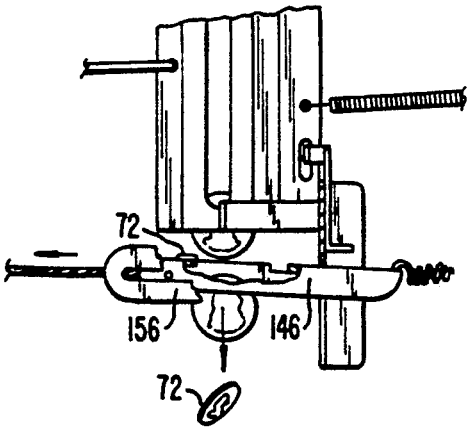

As illustrated in FIGS. 8C and 9C, coin bar 146 has a central cavity 156 in back of ramp 72. When the ramp has traversed coin 72, quarter 74 drops through the central cavity and into coin box 82, along with any other coinage in the coin holder.

Figure 8D:
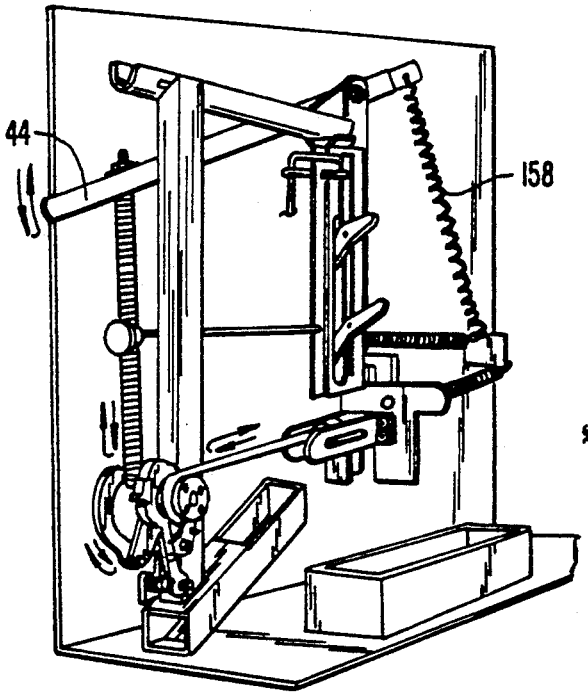
Figure 9D:
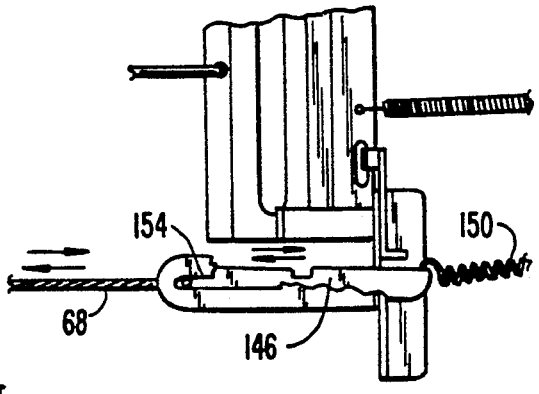

The completed stroke of handle 44 is illustrated in FIGS. 8D and 9D. Pawl 8D is disengaged (see FIG. 2D) allowing handle 44 to be reversed, aided by spring 158. Forward movement of cable 68 is limited by the length of slot 154. Spring 150 will draw coin bar 146 rearwardly as the pressure on handle 44 is released to return the coin bar to the position illustrated in FIGS. 8A and 9A.

Figure 10:
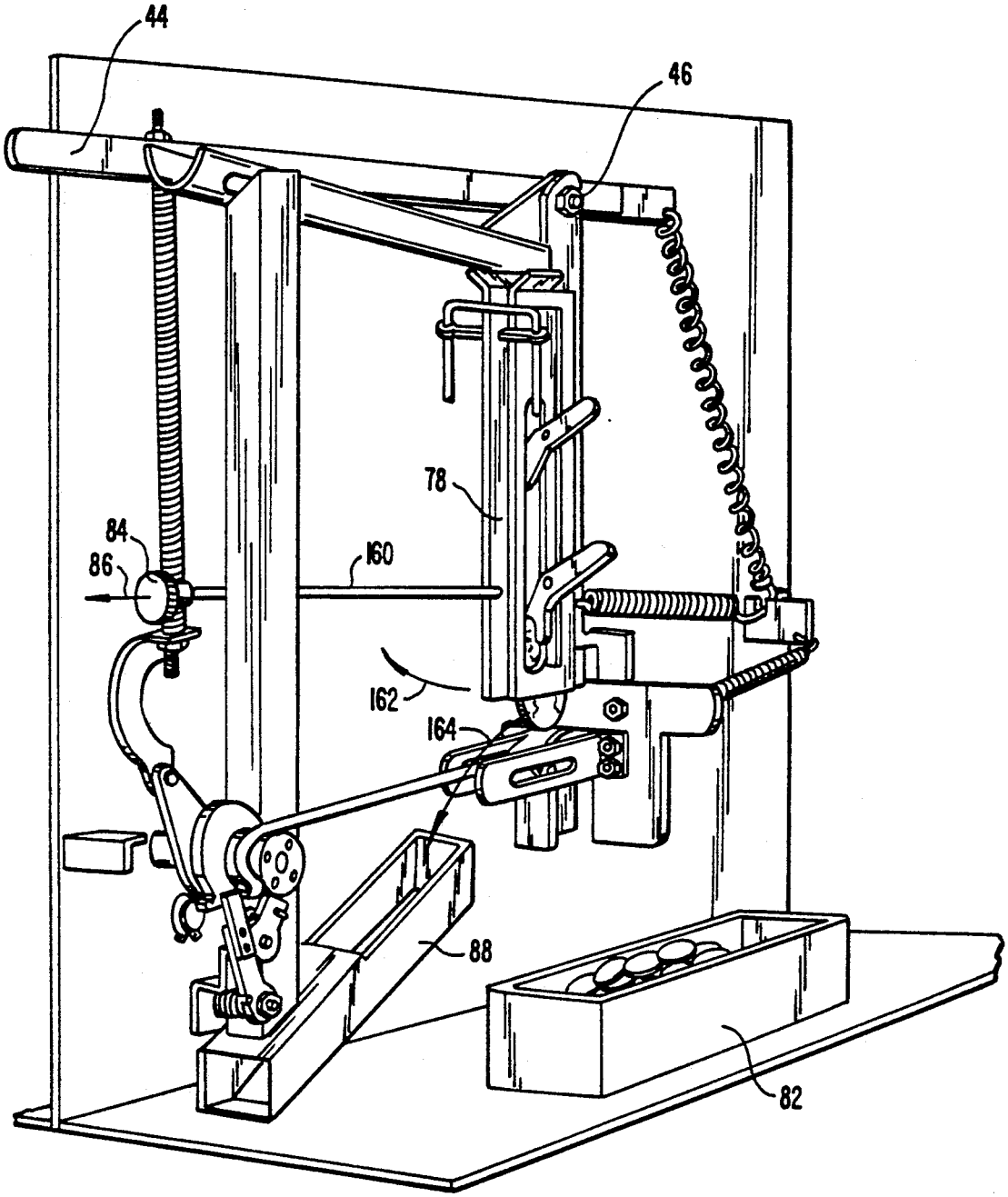
FIG. 10 is a fragmentary perspective view illustrating the coin return mechanism of the preferred embodiment.

As illustrated in FIG. 10, coin holder 78 is rotatable about the same shaft 46 as handle 44. Coin return button 84 is mounted on a shaft 160 fixed to coin holder 178. Before a paper has been dispensed, the customer can retrieve his coinage by pulling coin return button 84, as illustrated by arrow 86. This will rotate coin holder 78 about shaft 46, as illustrated by arrow 162. Rather than fall down into coin box 82, the coins will drop forwardly, as illustrated by arrow 164, into coin return chute 88.

In operation, the customer inserts the appropriate coinage in slot 76, and waits until it drops to the bottom of coin holder 78. The customer then presses down on handle 44, and the coinage releases coin bar 146, allowing the handle to rotate cam shaft 38. Pressure on the cam shaft is limited by spring 58 to prevent damage to the system. Initial rotation of the cam shaft causes brake 40 to contact belts 15 and 16, immobilizing the stack of papers located thereon. Further rotation of cam shaft 38 causes dispensing cam elements 34–37 to engage the forwardmost paper, with plates 22–24 adjusted so that only the forwardmost paper is engaged. The dispensing cam elements lift and separate the forwardmost paper from the rest of the stack and drop it into slot 30.

While a preferred embodiment of the present invention is illustrated in detail, it is apparent that modifications and adaptations of that embodiment will occur to those skilled in the art. However, it is to be expressly understood that such modifications and adaptations are within the spirit and scope of the present invention, as set forth in the following claims.

What is claimed is:

1. A single paper dispenser comprising:

an enclosure having a transverse aperture at one end and a discontinuous transverse member proximate the transverse aperture;

means within the enclosure for biasing a horizontal stack of papers against said transverse member;

cam means including a plurality of dispensing cam elements and a ratchet disposed on a common cam shaft rotatable about an axis parallel to the transverse aperture, said cam means having tongue means movable upwardly through the discontinuities in the transverse member and then forwardly relative to the transverse member upon rotation of the cam means;

means for disabling the biasing means upon rotation of the cam means;

means for simultaneously rotating the cam means and actuating the disabling means so that the cam means engages the forwardmost paper in the stack with the tongue means while the remainder of the stack is immobilized to lift and separate the forwardmost paper from the remainder of the stack and drop the separated paper past the transverse member to the transverse aperture, said rotating and biasing means including a pawl engageable with the ratchet to prevent rehearsal of the rotating means to dispense more than one paper; and an antitheft plate secured to the cam shaft to inhibit access by hand to the papers through the transverse slot.

2. The dispenser of claim 1 wherein each dispensing cam element includes a tongue portion and a curved portion following the tongue portion to hold the lower edge of the next paper in the stack in position as the forwardmost paper is separated therefrom.

3. The dispenser of claim 1 wherein the rotating and disabling means includes a handle, and a spring connection between the handle and the ratchet to limit the force exertable on the ratchet by the handle.

4. The dispenser of claim 1 wherein the biasing means includes a horizontal belt on which the papers rest on their lower edges, a backplate fixed to and extending upwardly from the belt to support the papers in a generally vertical position, and means for biasing the belt toward said end of the enclosure.

5. The dispenser of claim 4 wherein the disabling means comprises a brake operable against the belt and means for actuating the brake upon rotation of the cam means.

6. The dispenser of claim 5 wherein the cam means includes a plurality of dispensing cam elements disposed on a common cam shaft, and the brake includes a brake shoe adapted to engage the belt and brake cam means on the cam shaft which biases the brake shoe against the belt upon rotation of the cam shaft.

7. A single paper dispenser comprising:

an enclosure having a transverse aperture at one end and a discontinuous transverse member proximate the transverse aperture.

conveyor means for the stack of papers including a horizontal belt adapted to support the papers at their lower edges, a backplate fixed to and extending upwardly from the belt to support the papers in a generally vertical position, and means for biasing the belt toward said end of the enclosure to bias the stack of papers against said transverse member;

brake means operable to prevent movement of the belt;

cam means including a cam shaft rotatable about an axis parallel to the transverse aperture, a plurality of dispensing cam elements fixed to the cam shaft and having tongue means movable upwardly through the discontinuities in the transverse member and then forwardly relative to the transverse member upon rotation of the cam means, and brake cam means fixed to the cam shaft and engageable with the brake means to prevent movement of the belt upon rotation of the cam means; and means for rotating the cam shaft to engage the forwardmost paper in the stack with the tongue means while the remainder of the stack is immobilized to lift and separate the forwardmost paper from the remainder of the stack and drop the separated paper past the transverse member to the transverse aperture, said rotating means including a coin holder, a coin bar, stop means normally engaging the coin bar, and means for rotating the coin bar to disengage the stop means upon actuation of the rotating and disabling means when the appropriate coinage is inserted in the coin holder.

8. A single paper dispenser comprising:

an enclosure having a transverse aperture at one end and a discontinuous transverse member proximate the transverse aperture;

means within the enclosure for biasing a horizontal stack of papers against said transverse member;

cam means including a cam shaft rotatable about an axis parallel to the transverse aperture, a plurality of dispensing cam elements fixed to the cam shaft and having tongue means movable upwardly through the discontinuities in the transverse member and then forwardly relative to the transverse member upon rotation of the cam means, and a ratchet fixed to the cam shaft;

means for simultaneously rotating the cam means and disabling the biasing means so that the cam means engages the forwardmost paper in the stack with the tongue means while the remainder of the stack is immobilized to lift and separate the forwardmost paper from the remainder of the stack and drop the separated paper past the transverse member to the transverse aperture, said rotating and biasing means including a pawl engageable with the ratchet to prevent reversal of the rotating means to dispense more than one paper; and an antitheft plate secured to the cam shaft to inhibit access by hand to the papers through the transverse slot.

9. A single paper dispenser comprising:

an enclosure having a transverse aperture at one end and a discontinuous transverse member proximate the transverse aperture, said discontinuous transverse member including at least one planar element with a raised, slotted lip portion against which the papers are biased;

conveyor means for the stack of papers including a horizontal belt adapted to support the papers at their lower edges, a backplate fixed to and extending upwardly from the belt to support the papers in a generally vertical position, and means for biasing the belt toward said end of the enclosure to bias the stack of papers against said transverse member;

a brake shoe adapted to engage the belt;

cam means including a cam shaft rotatable about an axis parallel to the transverse aperture, a plurality of dispensing cam elements fixed to the cam shaft and having tongue means movable upwardly through the discontinuities in the transverse member and then forwardly relative to the transverse member upon rotation of the cam means, brake cam means on the cam shaft which biases the brake shoe against the belt upon rotation of the cam shaft, and a ratchet fixed to the cam shaft;

means for rotating the cam shaft including a handle, a spring coupling the handle to the ratchet, a coin holder, a coin bar, stop means normally engaging the coin bar, means for rotating the coin bar to disengage the stop means upon actuation of the rotating and disabling means when the appropriate coinage is inserted in the coin holder, and a pawl engageable with the ratchet to prevent reversal of the cam shaft rotation, so that the dispensing cam elements engage the forwardmost paper in the stack with the tongue means while the remainder of the stack is immobilized to lift and separate the forwardmost paper from the remainder of the stack and drop the separated paper past the transverse member to the transverse aperture, said rotating and biasing means including a pawl engageable with the ratchet to prevent reversal of the rotating means to dispense more than one paper.

10. The dispenser of claim 9 wherein the location of the planar elements relative to the cam means is adjustable to accommodate papers of different thicknesses without repositioning the cam means.

11. A single paper dispenser comprising:

an enclosure having a transverse aperture at one end and a discontinuous transverse member proximate the transverse aperture;

means within the enclosure for biasing a horizontal stack of papers against said transverse member including a horizontal belt on which the papers rest on their lower edges, a backplate fixed to and extending upwardly from the belt to support the papers in a generally vertical position, and means for biasing the belt toward said end of the enclosure;

cam means including a plurality of dispensing cam elements disposed on a common cam shaft rotatable about an axis parallel to the transverse aperture, said cam means having tongue means movable upwardly through the discontinuities in the transverse member and then forwardly relative to the transverse member upon rotation of the cam means to engage the forwardmost paper in the stack;

means for selectively immobilizing the next forwardmost paper in the stack including a brake shoe adapted to engage the belt and brake cam means on the cam shaft which biases the brake shoe against the belt upon rotation of the cam shaft; and means for simultaneously rotating the cam means and actuating the immobilizing means so that the cam means engages the forwardmost paper in the stack with the tongue means while the next forwardmost paper is immobilized to lift and separate the forwardmost paper from the remainder of the stack and drop the separated paper past the transverse member to the transverse aperture.

12. A single paper dispenser comprising:

an enclosure having a transverse aperture at one end and a discontinuous transverse member proximate the transverse aperture including at least one planar element with a raised, slotted lip portion against which the papers are biased;

conveyor means for the stack of papers including a horizontal belt adapted to support the papers at their lower edges, a back plate fixed to and extending upwardly from the belt to support the papers in a generally vertical position, and means for biasing the belt toward said end of the enclosure to bias the stack of papers against said transverse member;

brake means operable to prevent movement of the belt;

cam mans including a cam shaft rotatable about an axis parallel to the transverse aperture, a plurality of dispensing cam elements fixed to the cam shaft and having tongue means movable upwardly through the discontinuities in the transverse member and then forwardly relative to the transverse member upon rotation of the cam means, and brake cam means fixed to the cam shaft and engageable with the brake means to prevent movement of the belt upon rotation of the cam means; and means for rotating the cam shaft to engage the forwardmost paper in the stack with the tongue means while the remainder of the stack is immobilized to lift and separate the forwardmost paper from the remainder of the stack and drop the separated paper past the transverse member to the transverse aperture.

13. The dispenser of claim 12 wherein the location of the planar elements relative to the cam means is adjustable to accommodate papers of different thicknesses without repositioning the cam means.

14. A single paper dispenser comprising:

an enclosure having a transverse aperture at one end and a discontinuous transverse member proximate the transverse aperture;

a conveyor means for the stack of papers including a horizontal belt adapted to support the papers at their lower edges, a backplate fixed to and extending upwardly from the belt to support the papers in a generally vertical position, and means for biasing the belt toward said end of the enclosure to bias the tack of papers against said transverse member;

a brake shoe adapted to engage the belt;

cam means including a cam shaft rotatable about an axis parallel to the transverse aperture, a plurality of dispensing cam elements fixed to the cam shaft and having tongue means movable upwardly through the discontinuities in the transverse member and then forwardly relative to the transverse member upon rotation of the cam means, brake cam means on the cam shaft which biases the brake shoe against the belt upon rotation of the cam shaft, and a ratchet fixed to the cam shaft;

means for rotating the cam shaft including a handle, a spring coupling the handle to the ratchet, a coin holder, a coin bar, stop means normally engaging the coin bar, means for rotating the coin bar to disengage the stop means upon actuation of the rotating and disabling means when the appropriate coinage is inserted in the coin holder, and a pawl engageable with the ratchet to prevent reversal of the cam shaft rotation, so that the dispensing cam elements engage the forwardmost paper in the stack with the tongue means while the remainder of the stack is immobilized to lift and separate the forwardmost paper from the remainder of the stack and drop the separated paper past the transverse member to the transverse aperture, said rotating and biasing means including a pawl engageable with the ratchet to prevent reversal of the rotating means to dispense more than one paper; and an antitheft plate secured to the cam shaft to inhibit access by hand to the papers through the transverse slot.

15. A single paper dispenser comprising:

an enclosure having a transverse aperture at one end and a discontinuous transverse member proximate the transverse aperture;

conveyor means for the stack of papers including a horizontal belt adapted to support the papers at their lower edges, a backplate fixed to and extending upwardly from the belt to support the papers in a generally vertical position, and means for biasing the belt toward said end of the enclosure to bias the stack of papers against said transverse member;

brake means operable to prevent movement of the belt;

cam means including a cam shaft rotatable about an axis parallel to the transverse aperture, a plurality of dispensing cam elements fixed to the cam shaft and having tongue means movable upwardly through the discontinuities in the transverse member and then forwardly relative to the transverse member upon rotation of the cam means, and brake cam means fixed to the cam shaft and engageable with the brake means to prevent movement of the belt upon rotation of the cam means;

means for rotating the cam shaft to engage the forwardmost paper in the stack with the tongue means while the remainder of the stack is immobilized to lift and separate the forwardmost paper from the remainder of the stack and drop the separated paper past the transverse member to the transverse aperture; and an antitheft plate secured to the cam shaft to inhibit access by hand to the papers through the transverse slot.

16. A single paper dispenser comprising:

an enclosure having a transverse aperture at one end and a discontinuous transverse member proximate the transverse aperture;

conveyor means for the stack of papers including a horizontal belt adapted to support the papers at their lower edges, a backplate fixed to and extending upwardly from the belt to support the papers in a generally vertical position, and means for biasing the belt toward said end of the enclosure to bias the stack of papers against said transverse member;

brake means operable to prevent movement of the belt;

cam means including a cam shaft rotatable about an axis parallel to the transverse aperture, a plurality of dispensing cam elements fixed to the cam shaft and having tongue means movable upwardly through the discontinuities in the transverse member and then forwardly relative to the transverse member upon rotation of the cam means, and brake cam means fixed to the cam shaft and engageable with the brake means to prevent movement of the belt upon rotation of the cam means; and means for rotating the cam shaft to engage the forwardmost paper in the stack with the tongue means while the remainder of the stack is immobilized to lift and separate the forwardmost paper from the remainder of the stack and drop the separated paper past the transverse member to the transverse aperture, said rotating means including a coin holder and unlocking means operable upon insertion of the proper coinage into the coin holder to allow rotation of the cam means.

* * * * *